US007477871B1

(12) United States Patent
Gurantz et al.

(10) Patent No.: US 7,477,871 B1
(45) Date of Patent: Jan. 13, 2009

(54) SIGNAL SELECTOR AND COMBINER SYSTEM FOR BROADBAND CONTENT DISTRIBUTION

(75) Inventors: Itzhak Gurantz, San Diego, CA (US); Ladd El Wardani, La Jolla, CA (US); Michael Landry, San Diego, CA (US)

(73) Assignee: Entropic Communications Inc., San Diego, CA (US)

( * ) Notice: Subject to any disclaimer, the term of this patent is extended or adjusted under 35 U.S.C. 154(b) by 884 days.

(21) Appl. No.: 11/027,952

(22) Filed: Dec. 31, 2004

(51) Int. Cl.
*H04H 1/00* (2006.01)

(52) U.S. Cl. ..... 455/3.01; 455/3.02; 455/3.03; 455/3.04; 455/179.1; 725/71; 725/78

(58) Field of Classification Search ..... 455/3.01–3.05, 455/103, 137, 12.1, 20, 22, 179.1, 428, 427; 725/63–68, 39, 114, 117, 139, 74, 78, 81–83, 725/110, 149, 111, 118, 126–128, 148
See application file for complete search history.

(56) References Cited

U.S. PATENT DOCUMENTS

| | | | | |
|---|---|---|---|---|
| 5,835,128 | A * | 11/1998 | Macdonald et al. | 725/81 |
| 6,493,873 | B1 * | 12/2002 | Williams | 725/78 |
| 6,622,307 | B1 * | 9/2003 | Ho | 725/120 |
| 6,947,702 | B2 * | 9/2005 | Green et al. | 455/3.02 |
| 7,047,555 | B1 * | 5/2006 | Inaguma et al. | 725/149 |
| 7,197,760 | B1 * | 3/2007 | Graef | 725/68 |

* cited by examiner

*Primary Examiner*—Sujatha Sharma
(74) *Attorney, Agent, or Firm*—Robert Hart; Bruce W. Greenhaus

(57) ABSTRACT

In a satellite receiving system, program channels are selected from one or more broadband signals and combined with other selected channels and transmitted from a first unit, for example an outdoor unit, to a second unit, for example a gateway, server, or set-top box, using a single cable. Channels can be selected by digitizing the broadband signal then digitally filtering to isolate the desired channels. The outputs of several LNBs can be selected and combined into one signal. Multiple set-top boxes can receive independent signals over a single cable from the outdoor unit.

74 Claims, 18 Drawing Sheets

PRIOR ART Figure 1

PRIOR ART Figure 2

Digital Frequency Translator and Filter with summer

Digital Routing of Digitized signals

Digital Routing of Digitized signals

SIGNAL SELECTOR AND COMBINER SYSTEM FOR BROADBAND CONTENT DISTRIBUTION

RELATED APPLICATIONS

This application claims priority to U.S. provisional patent application No. 60/345,965 filed 7 Nov. 2001 titled "Signal Selector and Combiner for Broadband Content Distribution;" U.S. provisional patent application No. 60/333,722 filed 27 Nov. 2001 titled "Signal Selector and Combiner for Broadband Content Distribution;" U.S. provisional patent application No. 60/358,817 filed 22 Feb. 2002 titled "Signal Selector and Combiner for Broadband Content Distribution;" and non-provisional patent application Ser. No. 10/289,011 filed on 6 Nov. 2002 titled "Signal Selector and Combiner for Broadband Content Distribution" claiming priority to the three provisional patent applications listed above where each are incorporated by reference Also incorporated by reference are the following patents and patent applications: the Williams U.S. Pat. No. 6,134,419, entitled "Transmodulated Broadcast Delivery System for use in Multiple Dwelling Units" and the Petruzzelli U.S. Pat. No. 5,959,592, entitled "'IF' Bandstacked Low Noise Block Converter Combined with Diplexer."

BACKGROUND

1. Field of the Invention

This application relates to the field of satellite signal reception.

2. Background of Related Art

FIG. 1 discloses a satellite receiver outdoor unit ("ODU") 110 typically comprises a dish antenna 150, one or more antenna feed horns 130, one or more low noise amplifier and block down converters ("LNB") 140, and an optional multiport cross point switch 160. Dish 150 collects and focuses received signal power onto antenna feed horns 130 which couples the signal to LNBs 140. A single dish 150 may have multiple feed horns 130 where each feed receives a signal from a different satellite in orbit. An installation may have more than one dish, feed, and LNB assemblies. The cross point switch 160 allows connection of the outdoor unit 110 to more than one integrated receiver decoder ("IRD") 180 located inside the building. IRDs are commonly called set top boxes ("STBs") arising from their typical installed location on top of TV sets. The LNB 140 converts the signal transmitted by a satellite in Earth orbit, for example C band, Ku band, or another frequency band, to a lower intermediate frequency ("IF") suitable for transmission through coax inside a building. For example, the L band IF (950 to 1450 MHZ) with RG-6 or RG-11 coax cable is commonly used. The IRD 180 tunes one transponder channel, demodulates the IF signal from the LNB down to base band, provides channel selection, conditional access, decodes the digital data to produce a video signal, and generates an RF output to drive a television.

A satellite outdoor unit may have as many as three or more LNBs each with two receiving polarizations. The received polarization is selected by sending a voltage or other control signal to the LNB. In this configuration there are six possible 500 MHz signals that may be selected by the multiport cross point switch to be routed to each IRD. The 500 MHz signal is typically comprised of 16 transponder signals of 24 MHz bandwidth each with a guard band in between each transponder signal. Other transponder bandwidths are used such as 36 MHz, 54 MHz with a single channel or shared by two TV signals, and 43 MHz.

A problem with the conventional approach to connecting an outdoor unit to IRDs is that multiple cables are required to be run from the outdoor unit: one cable for each room where an IRD is located. When a new IRD is added another cable must be installed. In an application using a media server as central processor for all video signals, multiple cables are typically needed to route signals from the ODU to the server.

FIG. 2 illustrates a representative spectrum of the signal output by an LNB. In a conventional satellite ODU this signal is routed through a cross point switch to one of the IRDs. Note that all transponder channels in the signal are from a single LNB and from the same polarization satellite signal. The cross point switch allows any of the cables connected from the ODU to the IRDs to be switched to any of the LNBs. A dedicated cable for each IRD is needed because in general each IRD is not using the same LNB and polarization at the same time. A server requires access to several LNB signals simultaneously, thus requiring several cables.

The Williams U.S. Pat. No. 6,134,419, incorporated by reference, addresses part of the problem. The Williams patent recognizes that the bandwidth of the signal from each of the two polarizations is too broad to be transmitted over standard RG-6 or RG-59 cable, particularly when combined with community access television or what is commonly known as cable TV ("CATV") signals. Williams addresses this problem using a transmodulator, by demodulating and remodulating to a different modulation scheme the RHCP and LHCP signals using a tuner, decoder, packetizer, cable encoder, and up converter for each of 32 transponder channels. The transmodulator outputs a signal with a higher-level modulation scheme to reduce the bandwidth occupied by the satellite signals. In the example provided, the QPSK signals from the LNBs are transmodulated to 128-QAM, reducing the bandwidth from 1000 MHz to 192 MHz. At the set top box (STB) the 128 QAM signal is demodulated and processed to produce an NTSC analog video signal sent to a television set.

One problem with the Williams approach is the circuit complexity due to the 32 tuner paths required in the transmodulator. For an increase in the number of satellite signals, this problem becomes more pronounced. Williams discloses modulation using 128-QAM, which requires a higher signal to noise ratio (SNR) than QPSK and is it more susceptible to impairment from multipath present in a cable environment.

The Petruzzelli U.S. Pat. No. 5,959,592 incorporated by reference, addresses combining both the left hand circular polarized (LHCP) and right hand circular polarized (RHCP) signals into one signal that is transmitted from the ODU. In the disclosed band stacking approach, the output of two low noise amplifiers (LNAs), each 500 MHz wide, are frequency translated to different IF frequencies and summed into a signal with a bandwidth of more than 1000 MHz. In one example disclosed in the '592 patent, the different IF bands are 950 to 1450 MHz and 1550 to 2050 MHz. The problem with this approach is that the resulting bandwidth is very wide and becomes impractical when the number of LNB signals increases because each LNB output requires 500 MHz of bandwidth on the cable.

SUMMARY

A channel selecting and combining solution is used in the outdoor unit where one or more transponder channels are selected from each LNB output. The transponder channel or channels needed from each LNB are selected by a filter. Each selected transponder signal may be translated to a new channel frequency. The selected transponder channels are combined to form a composite signal. All of the selected, translated, and combined transponder channels are transmitted over a single cable to a gateway unit that extracts the channels to distribute to the IRDs. The gateway can frequency translate each transponder channel to its original frequency. Alternatively, the IRDs connect directly from the cable or through a splitter and tune the desired transponder channels. A channel translation mapping table is used to coordinate the channel assignment between the original channels and new channels. In another alternative embodiment, the gateway transmits the video information over a digital data network.

Low noise amplifier and block down converters ("LNB") outputs can be sampled by a broadband A/D converter and filtered with a digital filter to select a transponder channel. Alternatively, a tuner can select a transponder channel. The selecting process extracts from the wide band LNB output a narrow band transponder channel.

Each IRD communicates the channels it needs to receive, directly or indirectly, to the signal selector. This information is used to select the transponder channel to combine in the signal selector output signal, the out door unit ("ODU") downlink. New IRD designs can incorporate a signaling channel that uses unoccupied regions of the frequency spectrum of the cable, or a wireless communication link, to communicate the channel information. To provide compatibility with existing IRDs, the channel information can be communicated by an IR or RF auxiliary channel to the gateway or outdoor unit.

Many newer homes have coaxial cable installed that runs to a central location. Typically, a gateway is located at the central location that receives the combined signal from the outdoor unit and distributes the signals to the IRDs. An IRD requests a channel through an IR or RF signal communicated to the gateway. The RF communication can be in the cable connecting the IRD to the gateway or a wired or wireless signal.

The invention requires only one cable wire to be routed from the outdoor unit to inside the building or to a gateway. Additional IRDs can be added without any installation effort needed on the outdoor unit. In certain configurations the invention eliminates the cross point switch.

The invention can be used along with other signals transmitted on the distribution cable. The combined transponder signal can occupy a predetermined region of the frequency spectrum while another service, such as CATV can occupy a different region. Another example of shared use of the cable is along with a single or band stacked satellite signal. In this example, frequencies such as 950-1450 and 1550-2050 are used by a conventional satellite system, and frequencies outside and between these frequency bands are occupied with a combined transponder signal. However, this invention may be implemented using L-band, C-band or Ku-band frequencies.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

DETAILED DESCRIPTION

Figure 1:
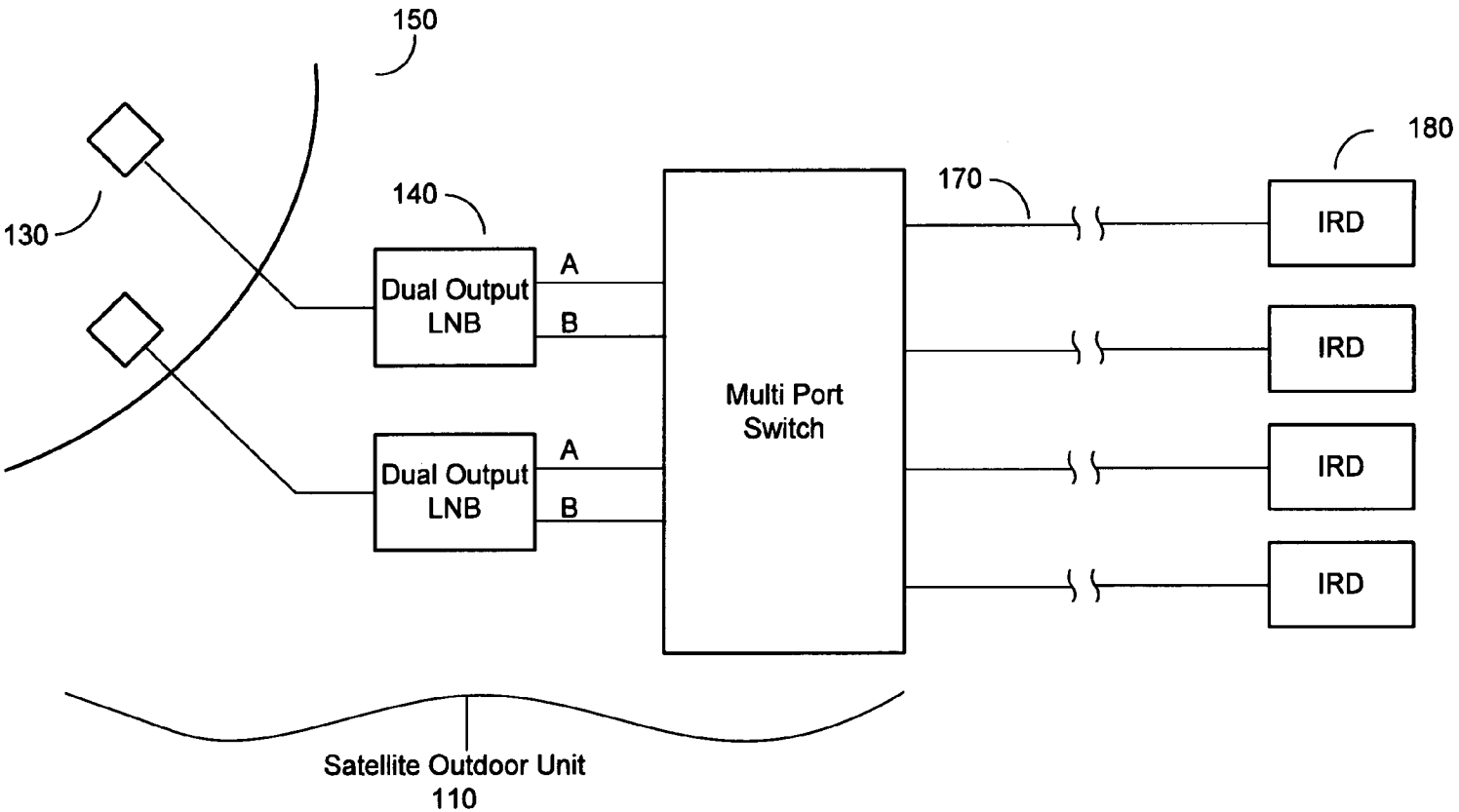
FIG. 1 is a prior art block diagram illustrating a satellite receiving system.
Figure 2:
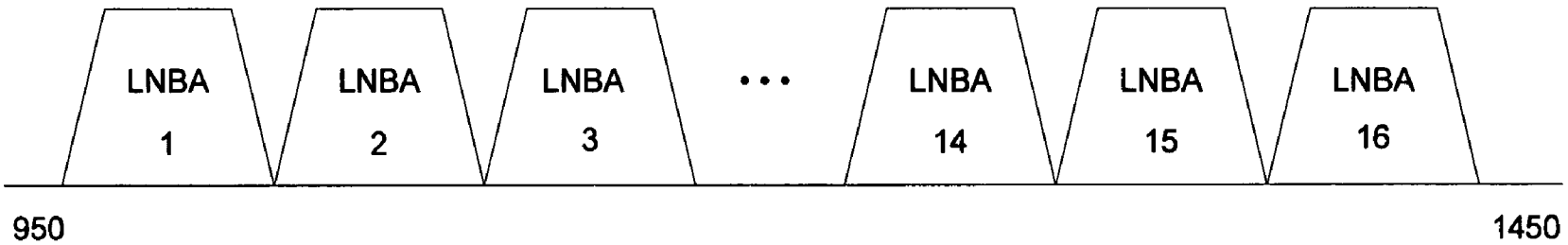
FIG. 2 is a prior art signal diagram illustrating the frequency spectrum of individual LNB output signals.
Figure 3:
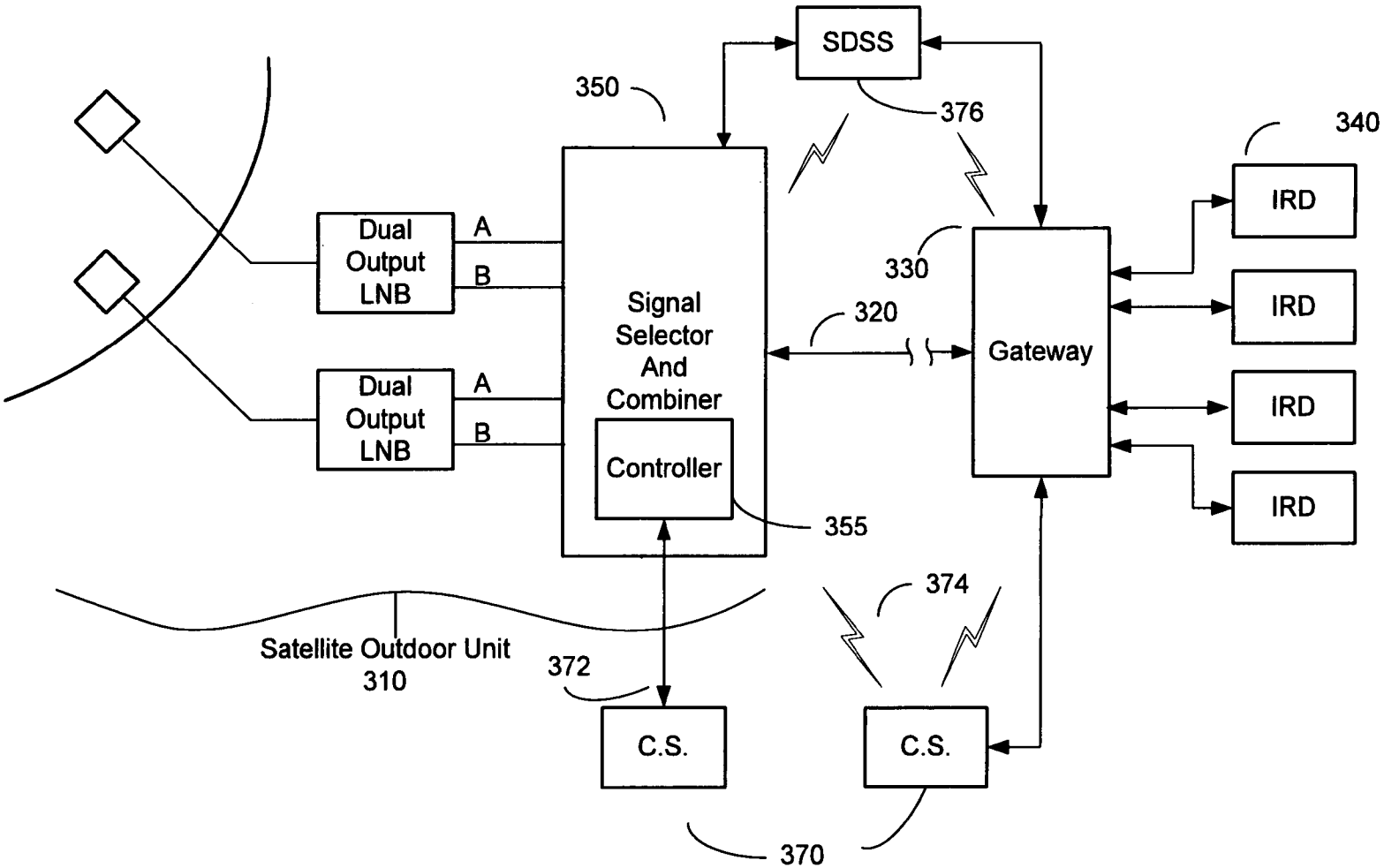
FIG. 3 is a block diagram illustrating a satellite receiving system.

FIG. 3 illustrates a satellite TV reception installation where a satellite outdoor unit 310 is capable of receiving at least one wide band signal comprising at least one narrow band signal. This invention may be implemented using L-band, C-band or Ku-band frequencies. Signal selector 350, part of satellite outdoor unit 310, extracts the needed transponder channels from each of the low noise amplifier and block down converters ("LNB") outputs and combines the channels into one composite signal transmitted on cable 320. Gateway 330 receives the signals and provides distribution to the IRDs located in the building. Controller 355 is responsible for communicating channel map, control, and status information with gateway 330 and IRDs 340. Controller 355 also tunes filters and local oscillators in the signal selector and maintains the channel map specifying the assigned frequency slots for transponder channels.

The controller 355 also allows users to specify frequency values of the narrow band signals that are to be selected by the signal selector and combiner. A communication system 370 may be connected to the gateway 330 or the controller 355 by a wire (coaxial cable, Ethernet, twisted pair, etc.), optical link 372 (fiber optic) or wireless link 374 (employing at least one multiplexing scheme such as packet routing, time division multiple access, frequency division multiple access, code division multiple access, orthogonal division multiple access, etc.) providing the controller with either user supplied settings or pre-selected settings. The controller 355 may contain microprocessors to facilitate operation. Also connected to the signal selector system may be a signal distribution sub-system 376. Instead of local oscillators, synthesizers may be used in all of the embodiments. Alternatively, the channel map can be maintained by gateway 330.

The communicator system 370 or the signal distribution sub-system 376 may be connected to a connected device (not shown) that enables users to communicate with the signal selector system via a communication link (physical or wireless). The communicator system 370 or the signal distribution sub-system 376 may facilitate signal selection of at least one narrow band signal by a user. The user can select the narrow band frequencies by selecting specific narrow band frequency values, channel sequence values or by allocating serial numbers to the desired narrowband frequencies. The communicator system 370 may also provide information regarding the arrangement of the narrow band signals that will form the output wide band signal. This communication link can also occur via the same pathway as that provided by the output signals. The communication pathway may transmit messages by a packet based system well known in the art. The communication pathway may transmit and receive signals by time division multiplexing, frequency division multiplexing, code division multiplexing, or orthogonal frequency division multiplexing.

Gateway 330 can be a simple power splitter/summer allowing the IRDs to connect directly to the cable. Gateway 330 would be located inside the home in a convenient location that allows connection to the IRDs 340. Gateway 330 is designed to pass signaling from IRDs 340 to outdoor unit ("ODU") 210 that contains the channel selection information.

Each LNB output signal is applied to a signal selector that extracts zero, one, or more transponder channels to be combined into a composite signal.

Figure 4:
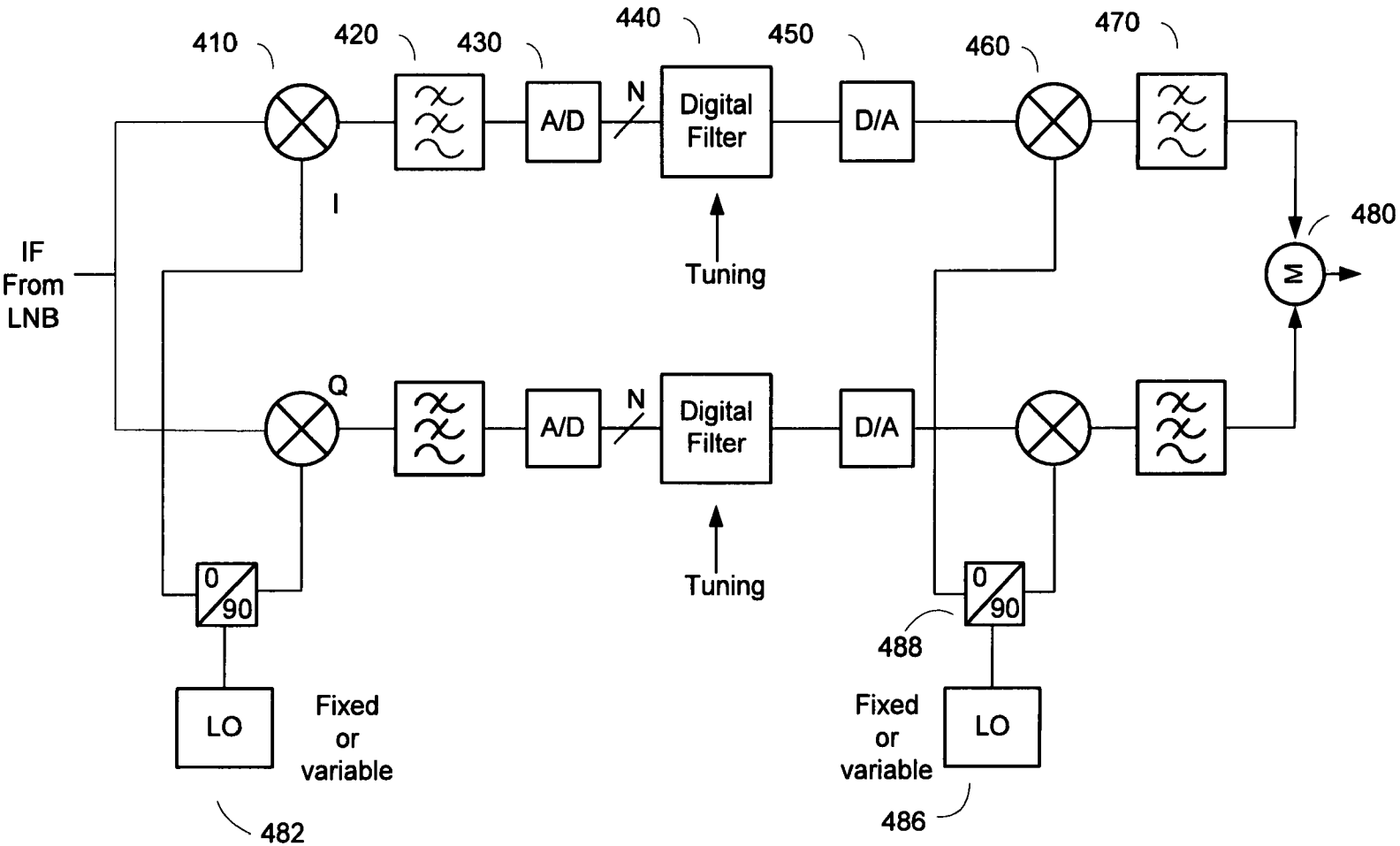
FIG. 4 is a block diagram illustrating a block diagram of a signal distribution system having a signal selector system and a communicator system.

In FIG. 4 a signal distribution system having a signal selector system and a communicator system is illustrated where a quadrature down converter is used to produce in-phase and quadrature analog signals. The down converter is comprised of a local oscillator 482, phase splitter 484 to produce an in-phase and quadrature-phase local oscillator, two mixers 410, and two filters 420. The filters 420 reject the undesired mixing products. The in-phase and quadrature signals are sampled by high-speed broadband A/D converters 430 to create in-phase and quadrature digital samples. The samples are N bits wide, where N is selected to limit the degradation to the signal to an acceptable level. The entire 500 MHz band is digitized by this operation. All further digital processing may be done using complex operations applied to the in-phase and quadrature digital samples. Typically, the sample rate is 500 MHz or higher.

The resolution of the A/D converters is in the range of 4 to 12 bits. To sample and reproduce a QPSK signal 6 to 8 bits would be adequate. More bandwidth efficient modulation such as 8PSK would require more bits of resolution. The selection of resolution is based on considering power consumption, SNR, and cost.

A coherent low oscillator generated by carrier tracking is not needed since the sampled data is not decoded in the ODU. An unknown carrier offset is present between the local oscillator and the carrier of the received signal. A small additional carrier offset is introduced by the down conversion process but will be removed in the carrier recovery operation in the IRD. It is desirable that the local oscillator carrier noise be low enough to be tracked out by the carrier loop in the IRD.

Digital filtering 440 may be used to select one or more of the transponder output signals. The digital filter may operate by applying a band pass filter transfer function to the broadband signal to isolate a single transponder channel. The filter uses known digital architectures such as finite impulse response (FIR) or infinite impulse response (IIR). The filter is tuned by programming a set of filter coefficients to select a specific pass band. Frequency domain filter can also be employed using FFT or DFT architectures. Other filtering techniques include polyphase filter structure. These filtering techniques are well known in the digital signal processing field. References covering digital filtering include Thomas J. Cavicchi "Digital Signal Processing" John Wiley & Sons, 2000; Sanjit K. Mitra, "Digital Signal processing, a Computer Based Approach" McGraw-Hill, 2001; Proakis and Manolakis, "Introduction to Digital Signal Processing," Macmillan Publishing, 1988; DSP and applications, Analog Devices.

Also in FIG. 4, the selected transponder channel is then frequency translated to a new carrier frequency. The selected and frequency translated digital signal is converted to an analog signal using a D/A converter for the in-phase and quadrature components. One approach is to convert the digitally filtered signal to the analog domain using a D/A converter 450, then using a quadrature modulator with mixers 460, phase splitter 488, local oscillator 486, and summer 480. Alternatively, this can be done by a digital mixing operation where a rotating phasor is multiplied by the data samples to translate their frequency, then converting the frequency shifted digital signal to an analog signal with a D/A.

Local oscillator 486 may be variable in order to allow the selected channel to be frequency translated to any of the channels available in the band. Alternatively, the local oscillator can be fixed at different a frequency for each of the channel selectors. Alternatively, a single transponder channel can be selected by translating the spectrum down in frequency to place the selected channel at base band then applying a low pass filter transfer function to isolate a single channel. The translation can be done by a digital mixing operation where the sample data is multiplied by a data sequence representing a carrier frequency. A post-mixing filter rejects the undesired mixing terms. Typically, processing of the input wide band signal should be less than three seconds. Otherwise, users may become frustrated or believe that the system is broken.

Figure 5:
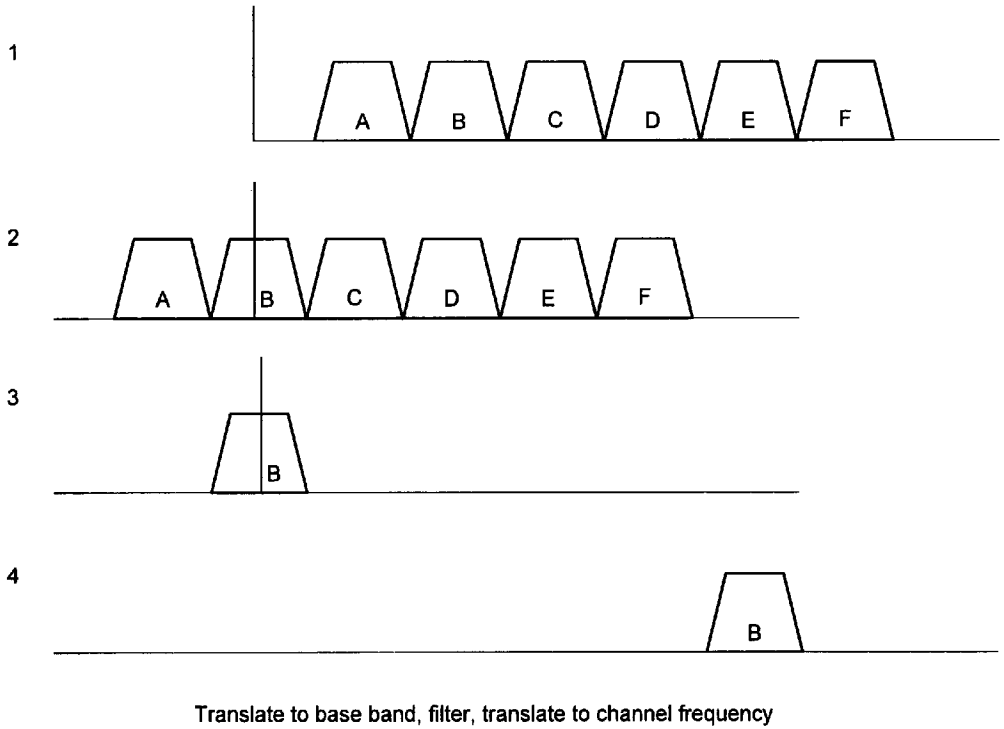
FIG. 5 is a signal diagram illustrating the frequency spectrum of signals in another embodiment using base band processing.

FIG. 5 shows the frequency spectrum of the signal as it is processed. The original spectrum 1 is frequency translated to locate the selected transponder channel at base band, as shown in spectrum 2. A low pass filter then passes one transponder channel and removes signal information from the other transponder channels, shown in spectrum 3. This signal is then converted to an analog signal, mixed to a new frequency, and summed with other channels in the analog domain. One summer input is provided for each signal selectors. This is a broadband signal comprising up to 16 or 32 channels. Alternatively, a summer combines the analog in-phase and quadrature signals from all the signal selectors.

Two basic approaches to combining are possible. One approach is to combine digitally filtered signals in the digital domain. This can be achieved with all filtered transponder channels to be combined presented at a sample rate equal to the composite output rate. The other approach is to combine the selected signals in the analog domain. This leads to two possible approaches to filtering. One is to implement filters with the same input and output sample rate. The other approach is to filter with an output sample rate that differs from the input sample rate.

An example of a digital combining embodiment, a 500 msps broadband sampling of the LNB output could be filtered to produce a 500 msps output stream representing one or more transponder channels. Each transponder channel may be frequency translated to the desired new carrier frequency, then filtered to produce a single transponder signal that can be combined with other similarly selected transponder channels.

Figure 6:
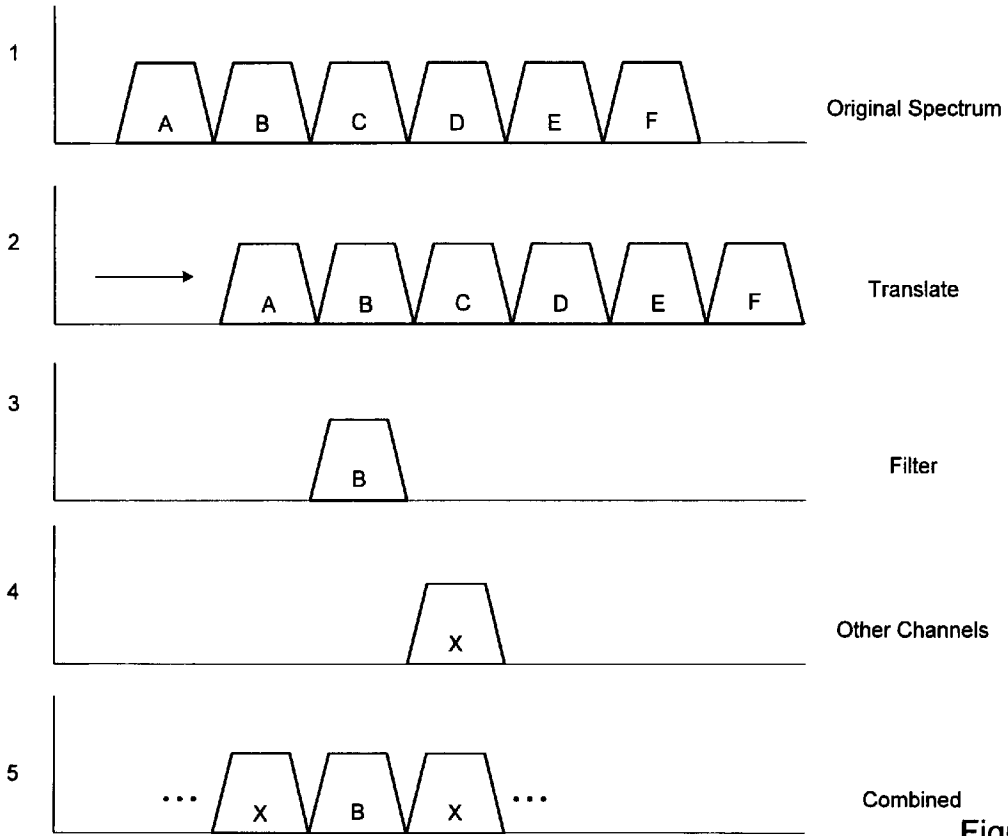
FIG. 6 is a signal diagram illustrating the frequency spectrum of signals at various points in the signal processing.

FIG. 6 shows the frequency spectrum of a sample stream as it is processed. The original spectrum 1 is frequency translated to locate the selected transponder channel at the desired frequency, as shown in spectrum 2. A band pass filter then passes one transponder channel and removes signal information from the other transponders channels, shown in spectrum 3. This filtering operation selects one transponder. In this example transponder channel B is selected. The sample stream for the selected channel is added to the sample stream from other filtering sections, represented in spectrum 4, to produce a composite sample stream in spectrum 5. Other selected channels are represented by channels labeled X.

Figure 7:
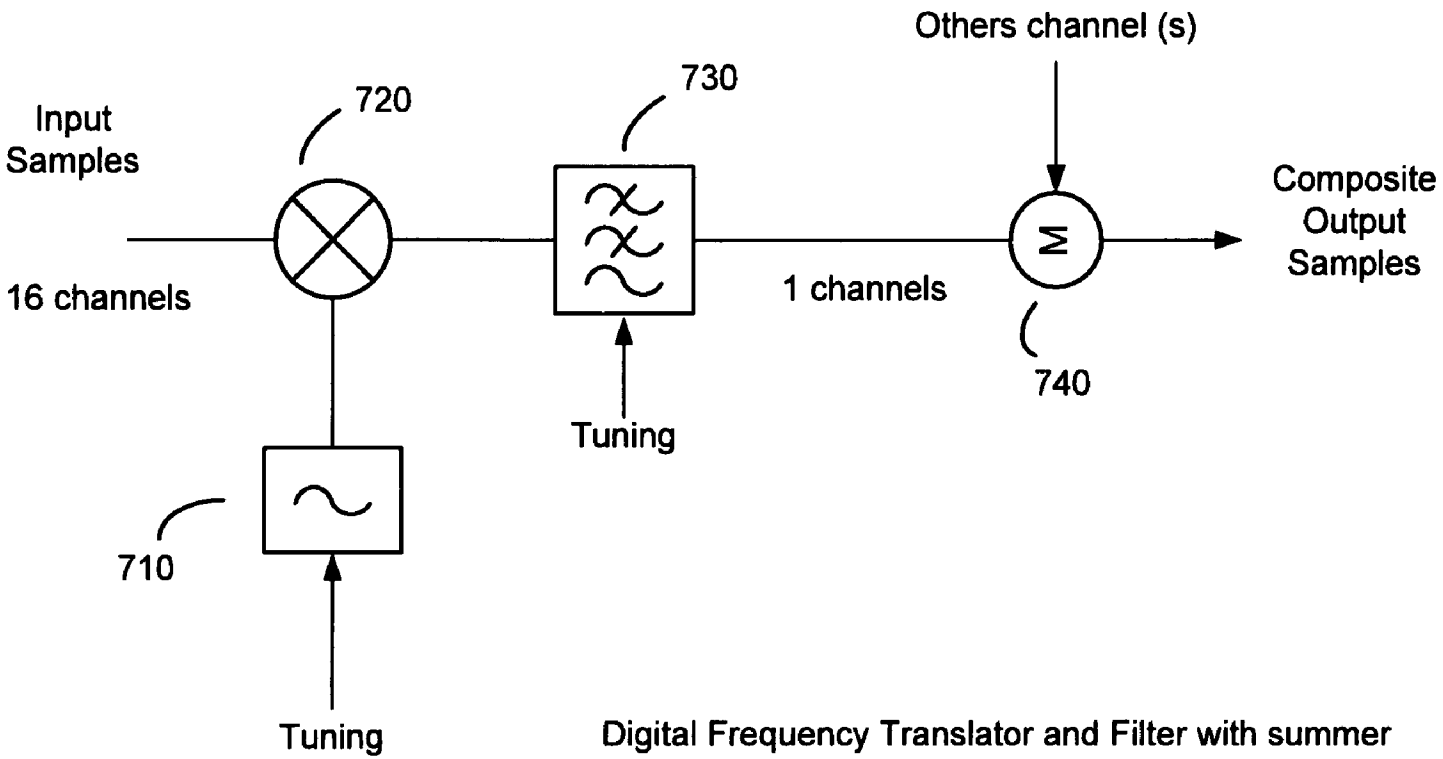
FIG. 7 is a block diagram illustrating one example of a frequency translator and filter.

FIG. 7 shows a block diagram of the processing elements to perform these steps. Local oscillator 710 feeds mixer 720 and is then band pass filtered by filter. Local oscillator is variable to allow the selected channel to be frequency translated to any of the channels available in the band. Filter 730 has a programmable pass band frequency, tuned by loading different filter coefficients. Summer 740 adds the sample stream to other sample streams. Several transponder channels are selected, each requiring one input to an adder. One embodiment uses a two input adder for each filter channel to implement a pipeline adder. The time delay introduced by a pipeline adder does not present a problem to the system because the receivers are each demodulating one transponder and the relative time delay is not apparent.

The frequency translation can occur either before or after the filtering operation. An advantage to translating first followed by filtering is that the filter removes the unwanted mixing terms generated. In either case, a rotating phasor is multiplied by the data samples to translate their frequency.

An example of an analog-combining embodiment, the digital filters may have an output sample rate that differs from the input sample rate. This can be inherent in the filtering operation or result from a down sampling done after filtering. Down sampling after the selecting filter is possible because the single channel the bandwidth is narrower than the A/D output and fewer samples are needed to represent the signal.

The spectrum is placed at the desired RF frequency by choosing the local oscillator frequency driving the up converters. One example would be 950 to 1450 MHz, a standard IF frequency for DBS systems. This frequency band is compatible with standard set top box (STB) hardware. Other IF frequencies could be used. Using this technique, standard STB hardware can receive the new composite signal and demodulate and decode the video and audio signals. Specific TV channels are located at new transponder frequencies. A mapping table allows the IRD/STB to tune to the correct transponder channel. The bandwidth of the spectrum can be 500 MHz for a 16-transponder system, 1000 MHz for a 32-transponder system, or other bandwidths according to the number of transponder channels present on the cable. If the system uses band stacking, the A/D converter can directly sample the 1000 MHz IF signal, with or without a frequency translation, or the two LNB polarizations can be separated into two 500 MHz signals each digitized with separate A/D converters.

Alternatively, the IF signal from the LNB can be directly band pass sampled by a single A/D converter. The IF signal can be frequency translated to a different IF frequency before band pass sampling. Band pass sampling requires a higher speed A/D converter than base band sampling, but only a single A/D.

One pair of A/D converters is provided for each LNB output. Alternatively, the LNB output can be band pass sampled using a single A/D converter. At a given point in time some LNB outputs may not be accessed by a user. If no transponder channel is selected from a particular LNB output, the A/D converters associated with that LNB output may be switched off to reduce power consumption and heat generation, or reallocated to process another LNB output.

The A/D digitizes the entire LNB output signal; therefore all transponder channels are available in the sampled data. More than one transponder channel may be selected from the A/D data to be combined in the composite signal. When all A/D are powered up any combination of transponder channels from any LNB output can be combined into the composite signal for distribution to the gateway and STBs.

Figure 8:
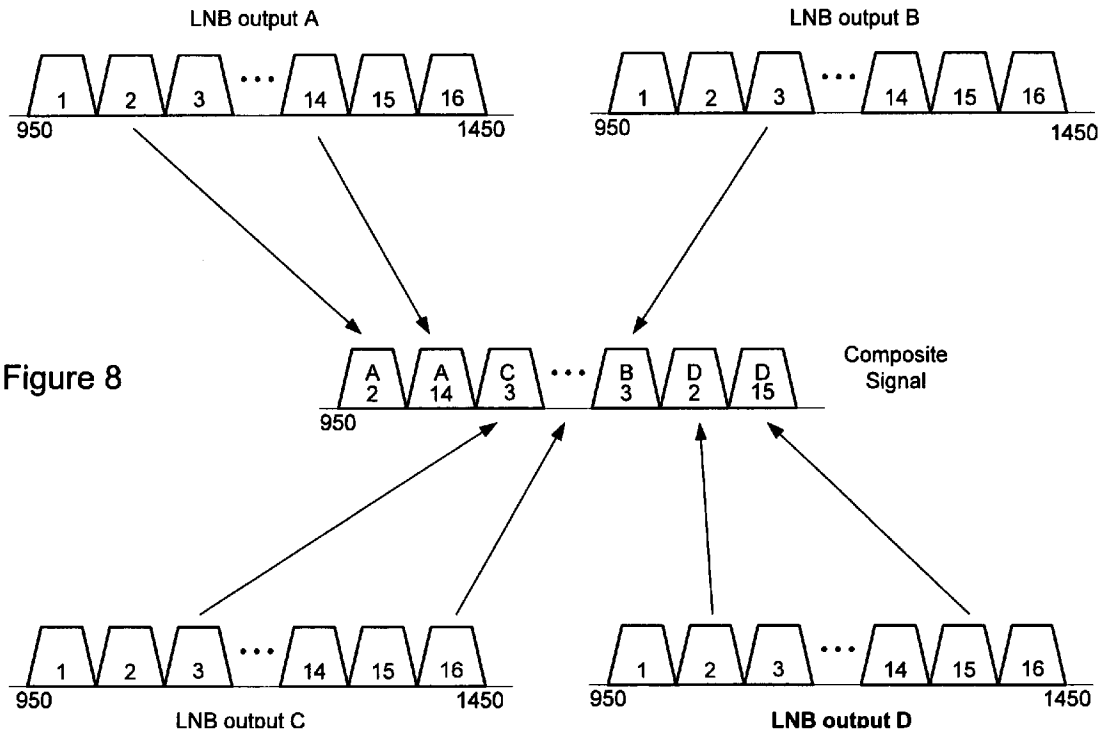
FIG. 8 is a signal diagram illustrating a diagram of the frequency spectrum of individual LNB output signals and the frequency spectrum of the composite wide band RF signal comprising selected transponder signals.

FIG. 8 shows a diagram of the frequency spectrum of individual LNB output signals and the frequency spectrum of the composite wide band RF signal comprising selected transponder signals. Each of the available channels can be occupied with any transponder channel of any polarization from any LNB. One or more channels are used by each active IRD connected to the system. The number of transponder channels in the composite signal can be from as few as 2 to as many as 32, depending on the number of simultaneous channels needed in the system.

In general, the selecting and combining process will result in transponder channels located at different frequencies than where originally found. A translation table maps original channel locations on the selector input to new channel locations on the selector output. This map created and maintained by a controller located in the ODU or the gateway and is communicated to the IRDs or other devices in the network.

The channel selector performs a frequency selective filtering operation to select the desired transponder frequency. The transition band of this filter is steep, passing the selected transponder channel and rejecting adjacent transponder channels. The transition region available is derived from the guard band between channels. This can be as small a few MegaHertz. If the LNB carrier offset is large, a shift in the spectrum will result in the selecting filter cutting off part of the desired spectrum and passing part of an adjacent channel. For this reason a carrier offset estimate is desirable. Since all transponder channels from a given LNB will have approximately the same offset, it is only necessary to monitor one transponder channel from each LNB to determine the offset for all channels. Any of several know techniques for estimating the carrier offset may be employed. One example is two use two filters each approximately half the transponder bandwidth. By measuring the ratio of power from each filter output, an estimate of the carrier offset can be determined. Once the carrier offset is estimated, the sampled signal can be multiplied by a rotating phasor value to digitally shift the spectrum back to the nominal position. Alternatively, this frequency offset correction can be done in the analog domain, or a combination of digital and analog approaches.

Another approach to addressing the unknown carrier offset in the LNB is to use a wider filter to select transponder channels, where the bandwidth of the filter passes the selected transponder and part of the adjacent spectrum. In this way, if the transponder signal is not centered in the filter bandwidth the band edges will not be attenuated by the filter roll off. This excess bandwidth will allow some energy from the neighboring transponder signals. A wider channel separation is needed on the combined signal, for example the selected transponders can be spaced twice the conventional spacing. This approach makes less efficient use of the cable spectrum but simplifies the hardware implementation by reducing the requirement of or eliminating the carrier offset correction. Additionally, a less steep filter roll off is possible.

Figure 9:
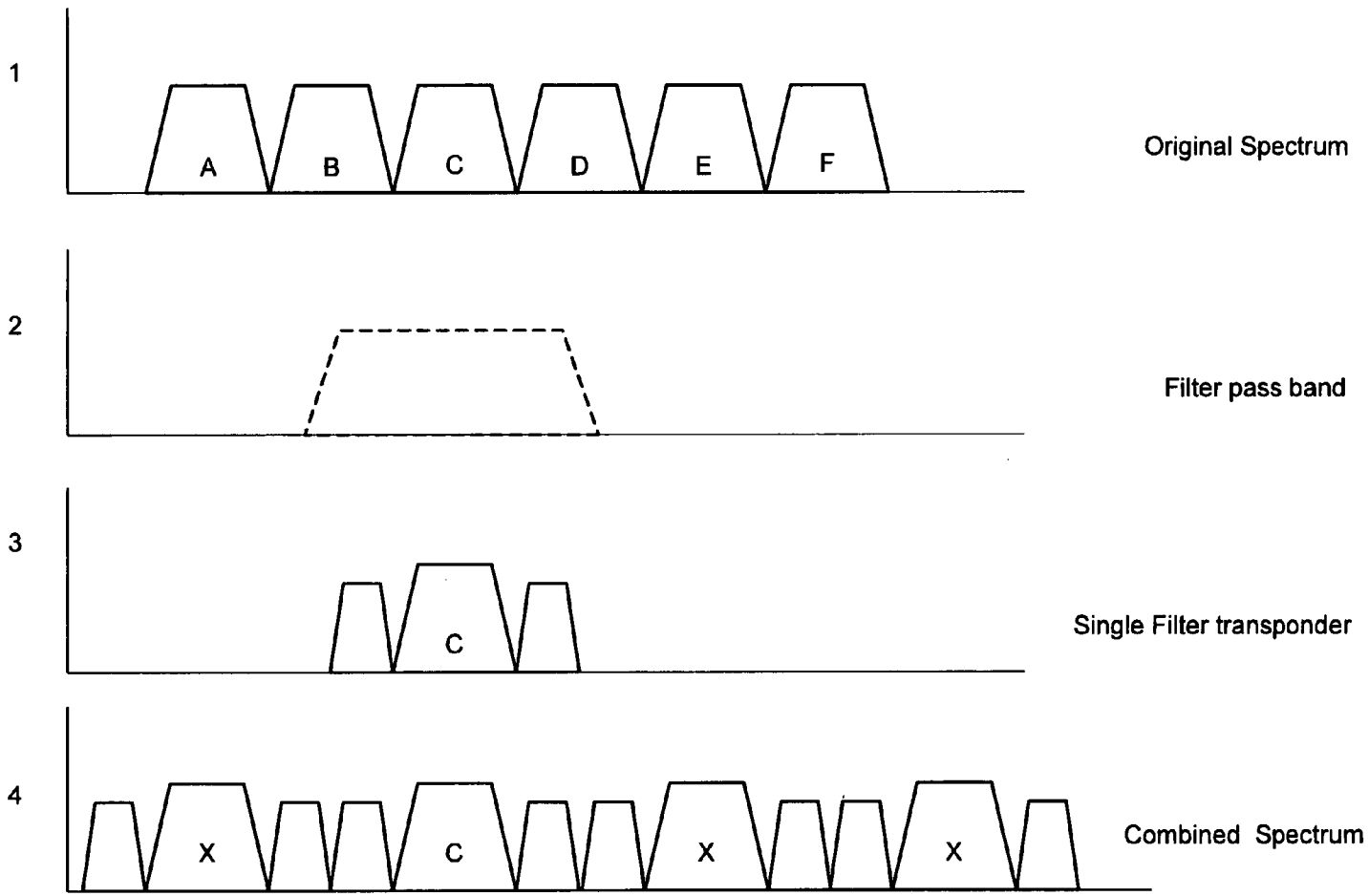
FIG. 9 is a signal diagram illustrating the frequency spectrum of signals filtered and combined with excess bandwidth.

FIG. 9 shows the signal spectrum as it is processed. Spectrum 1 is a representative original spectrum. Spectrum 2 shows the filter pass band characteristic, which is wider than one transponder channel. Spectrum 3 is the result of filtering one transponder channel. Spectrum 4 is a composite of several transponder channels. A region between the selected channels is unused. The exact shape of the unused spectrum will be dependent on the filter roll-off characteristics, but is not significant. The objective is to pass the selected transponder signal without distortion.

The approach of using a filter with excess bandwidth technique is also useful for implementing the invention using an analog approach. A filter with a stop band substantially wider than the transponder channel allow using filters with more gradual transition band, and is therefore simpler to implement. The excess bandwidth can range from less than 5% to 100% wider than the transponder bandwidth.

Figure 10:
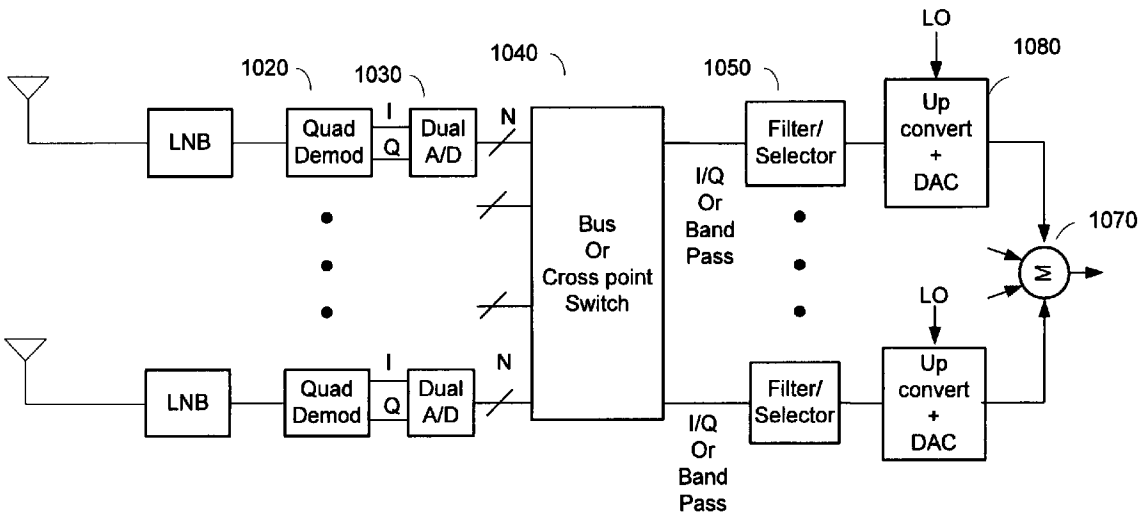
FIG. 10 is a block diagram illustrating an embodiment where the sampled data is distributed digitally to channel selector filters.

FIG. 10 shows an embodiment that uses a cross point switch or shared bus 1040 to distribute data from the A/Ds to the channel selecting filters. The cross point switch, also called crossbar switch, allows any signal input to be passed to any output. It can take the form of a data selector or multiplexer. Implemented as a shared bus, data sinks receive signals from data source using a time-multiplexed bus. Either a cross point switch or a shared bus can be unidirectional or bi-directional. Use of the cross point switch can be applied to digital or analog signals.

The wideband signal is received by the LNB and the LNB outputs are quadrature down converted 1020 and sampled by dual A/D converters 1030. The parallel data is routed through cross point switch 1040 so that any filter has access to any A/D data. Filter/selector 1050 selects the desired transponder channel that is then up converted by quadrature modulator 1060. Then, all selected channels are combined in summer 1070.

In FIG. 10, conversion of multiple circuits is disclosed. However, the use of multiple circuits can be minimized to one high speed circuit such as that illustrated in FIG. 4, but employing high speed A/D and D/A converters. Use of a high speed circuit eliminates the need for multiple circuits by substituting one high speed circuit. Such a high speed circuit may have improved robustness because it employs fewer components and because the high speed circuit is capable of filtering the entire in coming wide band signal so that a wide band signal can be out put by the high speed circuit. Typically, processing of the input wide band signal should be less than three seconds. Otherwise, users may become frustrated or believe that the system is broken.

Figure 11:
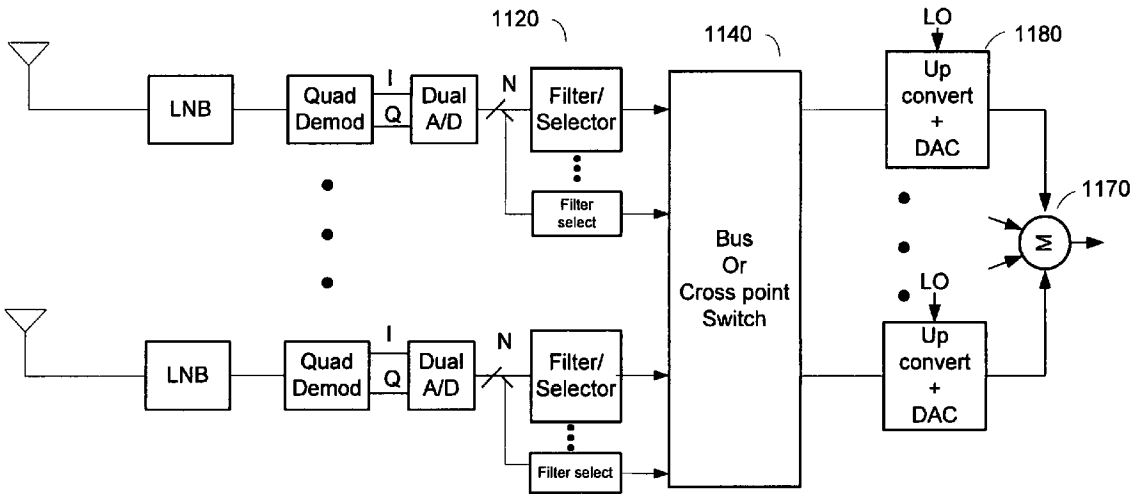
FIG. 11 is a block diagram illustrating an embodiment where the selected channel data is distributed digitally to the up converters.

FIG. 11 shows a variation where a bus or cross point switch 1140 is located after the selecting filter 1120. In this configuration the selecting filter 1120 may also include a down sampler to reduce the bus traffic bandwidth in the cross point switch 1140. Down sampling is possible because after selecting a single desired channel the bandwidth is narrower and fewer samples are needed to represent the signal. One or more selecting filters 1120 may be connected to the output of each A/D, each filter 1120 selecting one transponder channel.

Figure 12:
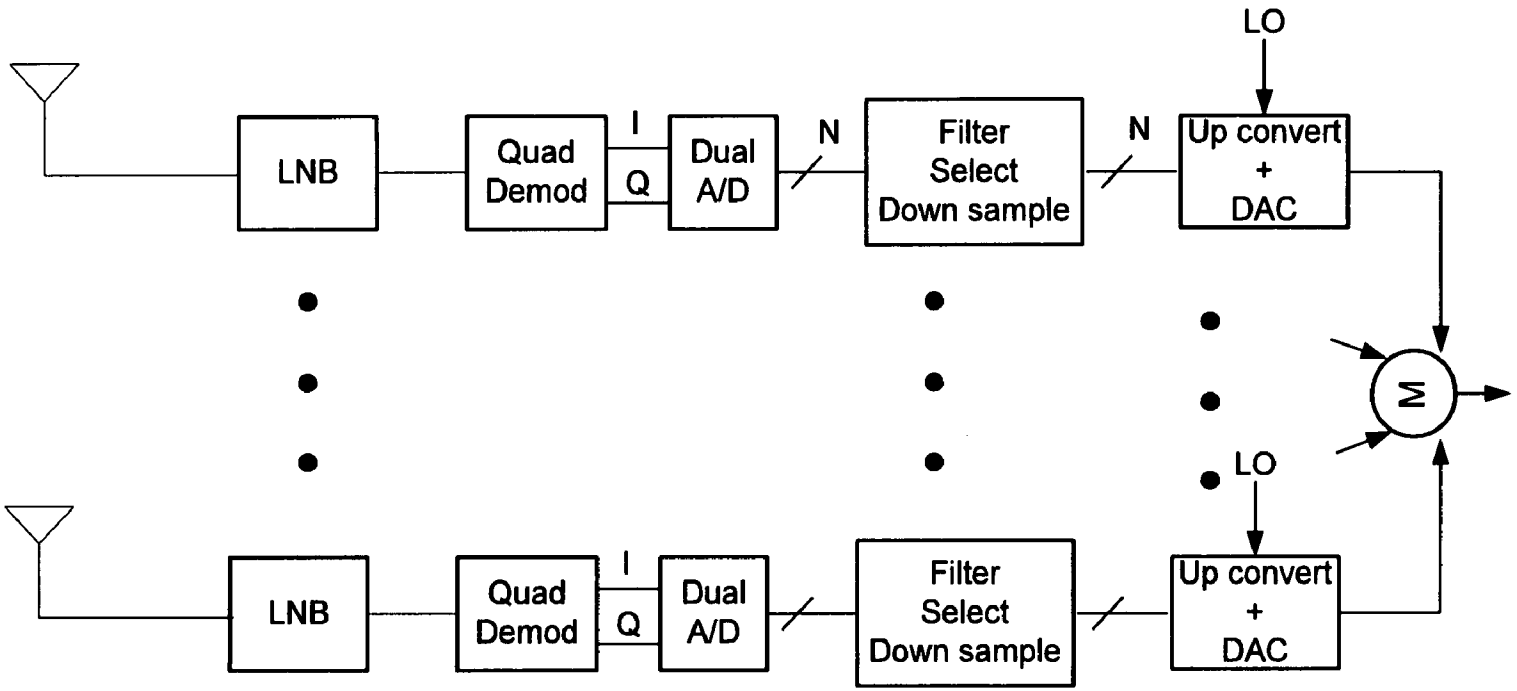
FIG. 12 is a block diagram illustrating an embodiment where the each LNB has a dedicated selector and up converter.

FIG. 12 shows a configuration where each LNB has a dedicated selecting filter and up converter. The selecting filter may digitally select multiple channels from the broadband A/D data to drive the up converter and DAC.

Figure 13:
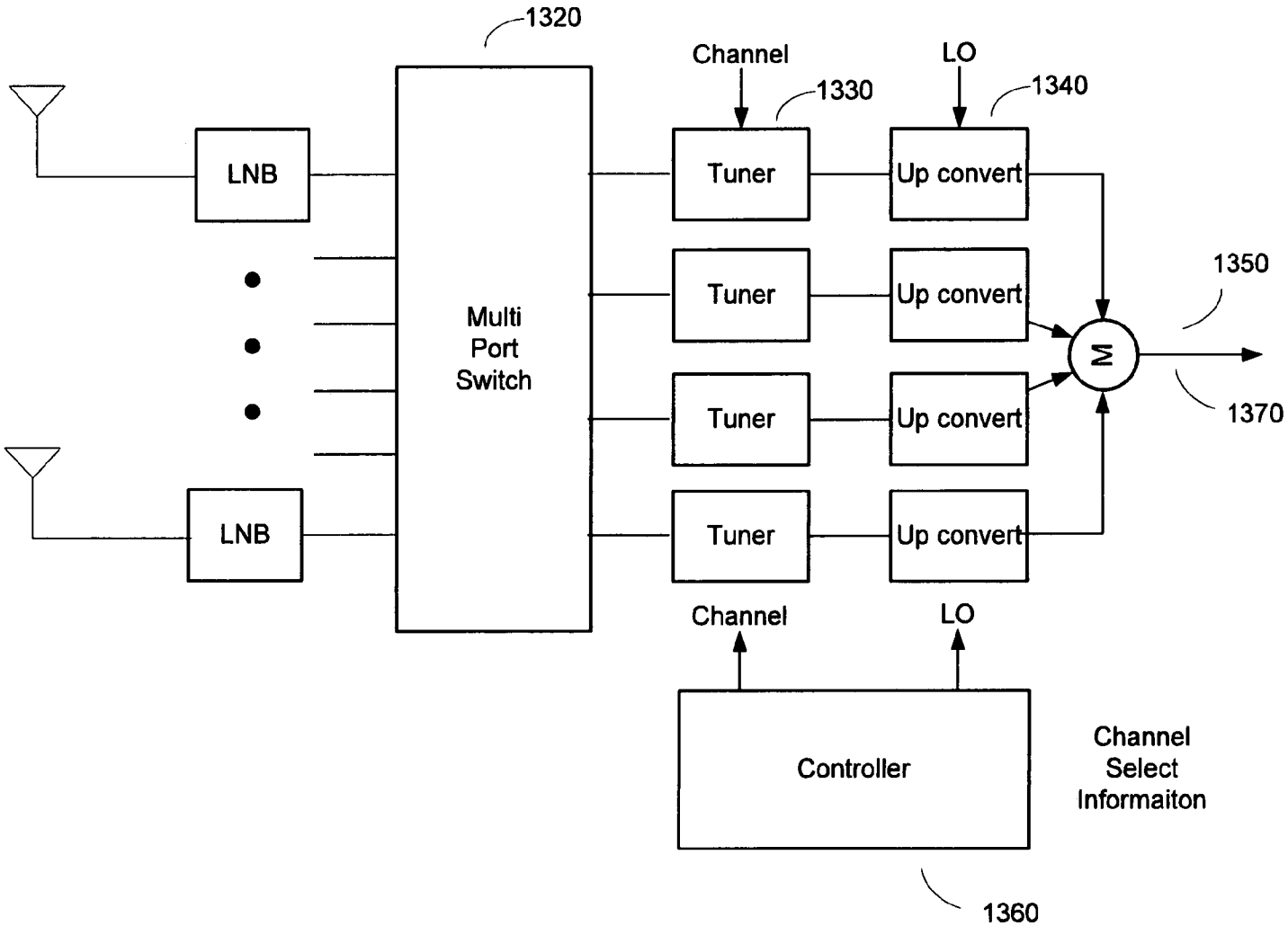
FIG. 13 is a block diagram illustrating an embodiment where tuners and up converter are used to select and combine transponder channels.

FIG. 13 shows another alternative where analog tuners 1330 select desired transponder channels from the incoming wide band signal by a multiport switch and are up converted by up converter 1340. All signals are combined by summer 1350 to drive the signal cable 1370 from the ODU. A multiport switch 1320 allows any tuner to connect to any LNB output. The number of signal selecting paths comprising tuner 1330 and up converter 1340 is selected based on the maximum number of simultaneous users. A multiple-tuner personal video recorder would use more than one signal. Controller 1360 receives channel select information either from the cable or a separate data channel such as infrared (IR) or wireless RF link or other source. Channel select information from the controller 1360 programs the tuner 1330 and up converter 1340 local oscillator. Channel select information can come to the controller over a wireless remote control signal or using signaling sent over the cable.

Up converters 1340 can operate at a fixed local oscillator frequency with one up converter 1340 being assigned to each user connected on the cable. The various local oscillator frequencies are unique. Alternatively, the down conversion process of each tuner 1330 can be set to down convert directly to a predetermined IF frequency which is unique for each selected signal, thereby eliminating a separate up converter. A simplified IRD can be used with this approach where the IRD needs only tune to a single selectable IF frequency. The tuning range is narrower than a convention 500 MHz tuner and the channel selection is limited to as few as four choices compared to up to 16 or more in a convention IRD tuner. Typically, processing of the input wide band signal should be less than three seconds. Otherwise, users may become frustrated or believe that the system is broken.

Figure 14:
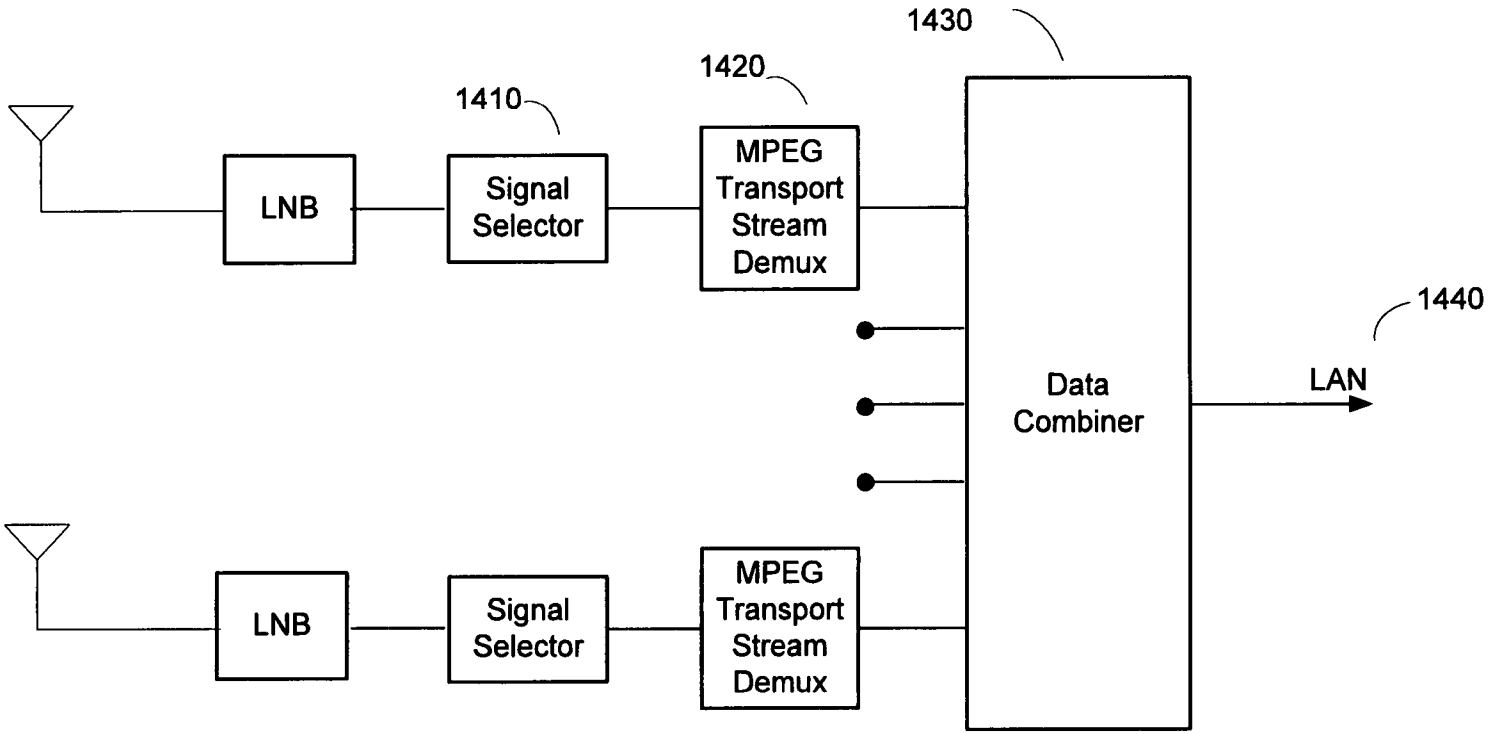
FIG. 14 is a block diagram illustrating an embodiment where selected channel are processed by an MPEG transport stream demultiplexer and combined as data packets for digital LAN transmission.

FIG. 14 shows another alternative where signal selector 1410 selects a transponder channel from an incoming wide band signal. MPEG transport stream demultiplexer 1420 extracts a specific video program that is combined by data combiner 1430. Several MPEG streams are multiplexed as needed, and packets are formatted for transmission on a digital network. A digital LAN 1440 connects directly to the ODU. Channel information is communicated to the ODU through the LAN.

Figure 15:
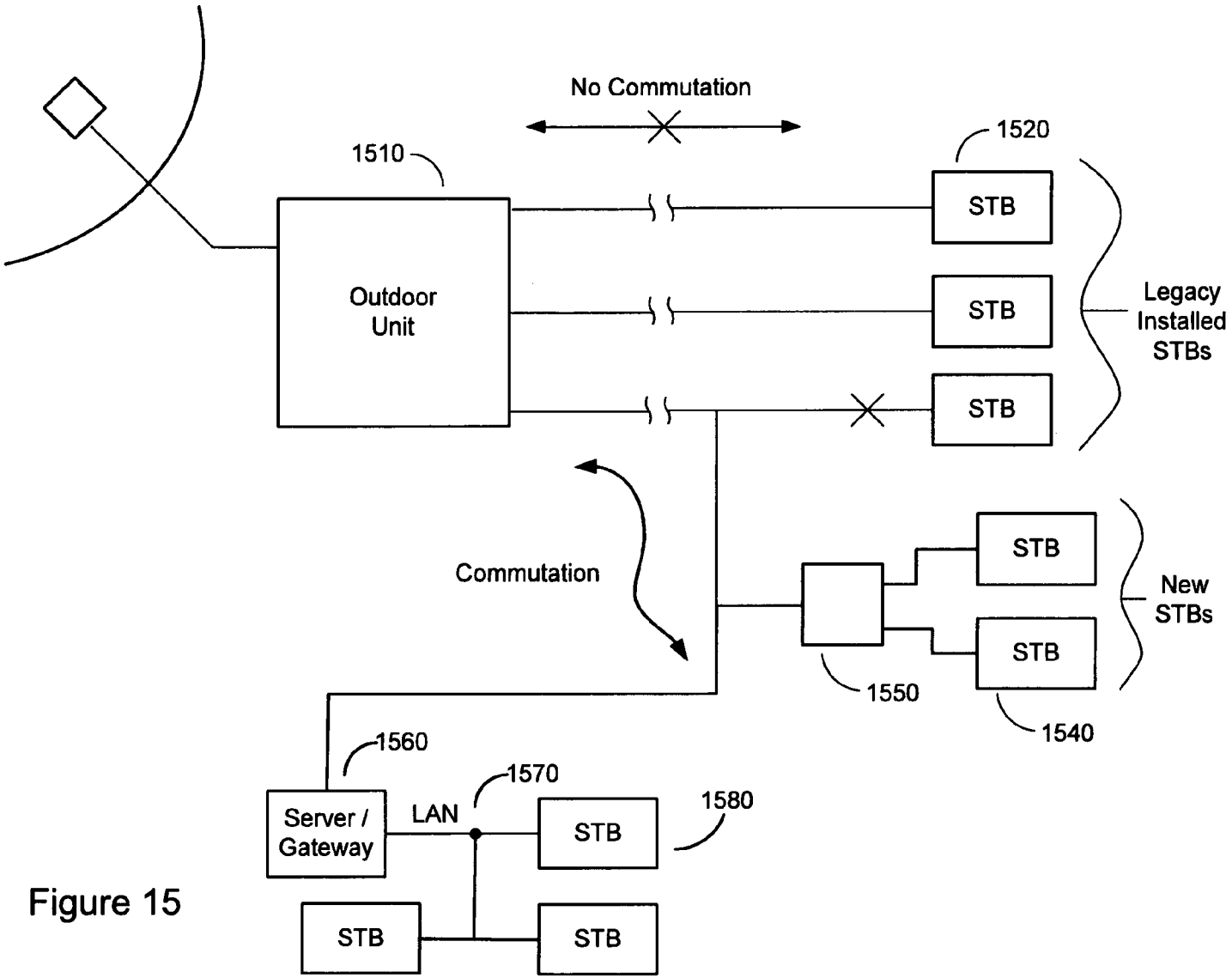
FIG. 15 is a block diagram illustrating a satellite TV installation providing compatibility with existing installed STBs and new STBs and using a server/gateway.

FIG. 15 shows another alternative used where new STBs are used with existing STBs. ODU 1510 supplies a signal to each of the connected cables according to the type of STB attached to the cable. Existing legacy STBs 1520 are supplied with an IF signal as in a conventional system, and the STBs 1520 will tune to a single transponder channel. New STBs 1540 will be supplied with a composite signal comprising all the transponder channels that are selected and the new STB 1540 will tune and decode the requested channel.

A new STB 1540 can be installed in place of an existing STB 1530 by simply connecting the new STB 1540 to the cable in place of the existing STB 1530. More than one new STB 1540 can be installed by using a signal splitter 1550 to provide a signal to multiple STBs. New STBs use a signaling system for selecting transponder channels that passes through the splitter to the ODU. Existing STBs will each have a dedicated connection to the ODU, as provided in the original installation. This is required because existing STBs use voltages or other control means to select LNB outputs that do not support multiple STBs on a single cable.

Also in FIG. 15, server/gateway 1560 receives the composite transponder signal, decodes specific programs, and distributes the program information in packetized MPEG over a digital local area network (LAN) 1570 to STBs 1580. Ethernet or other LAN technology is suitable for this function.

A new STB having a means of communication with the signal selector and combiner in the ODU may be provided. At power up or at periodic intervals the ODU or the STB initiates communication over the attached cable. This communication can be an in band or out of band signal. The ODU polls the STBs connected to determine if the STB is a conventional STB or new design STB. Because conventional STBs will not respond to the polling request, the absence of response is an indication of a conventional STB. A new STB will respond to the polling request and establish communication with the ODU.

The means of communication on the cable can be a TDMA frame structure with slots assigned to each STB, a frequency division multiplex (FDM) approach with unique frequencies assigned to each STB, or any other known technique for two-way communication by multiple devices over a signal channel. An extension of DiSEqC protocol commonly used for satellite dish control can be used for this communication. DiSEqC uses a gated 22 kHz carrier to communicate binary data and can be adapted for use to transfer data needed. The data rates are low for this communication path. Device configuration, channel mapping, and channel requests are among the types of data communicated between the ODU and STB.

Figure 16:
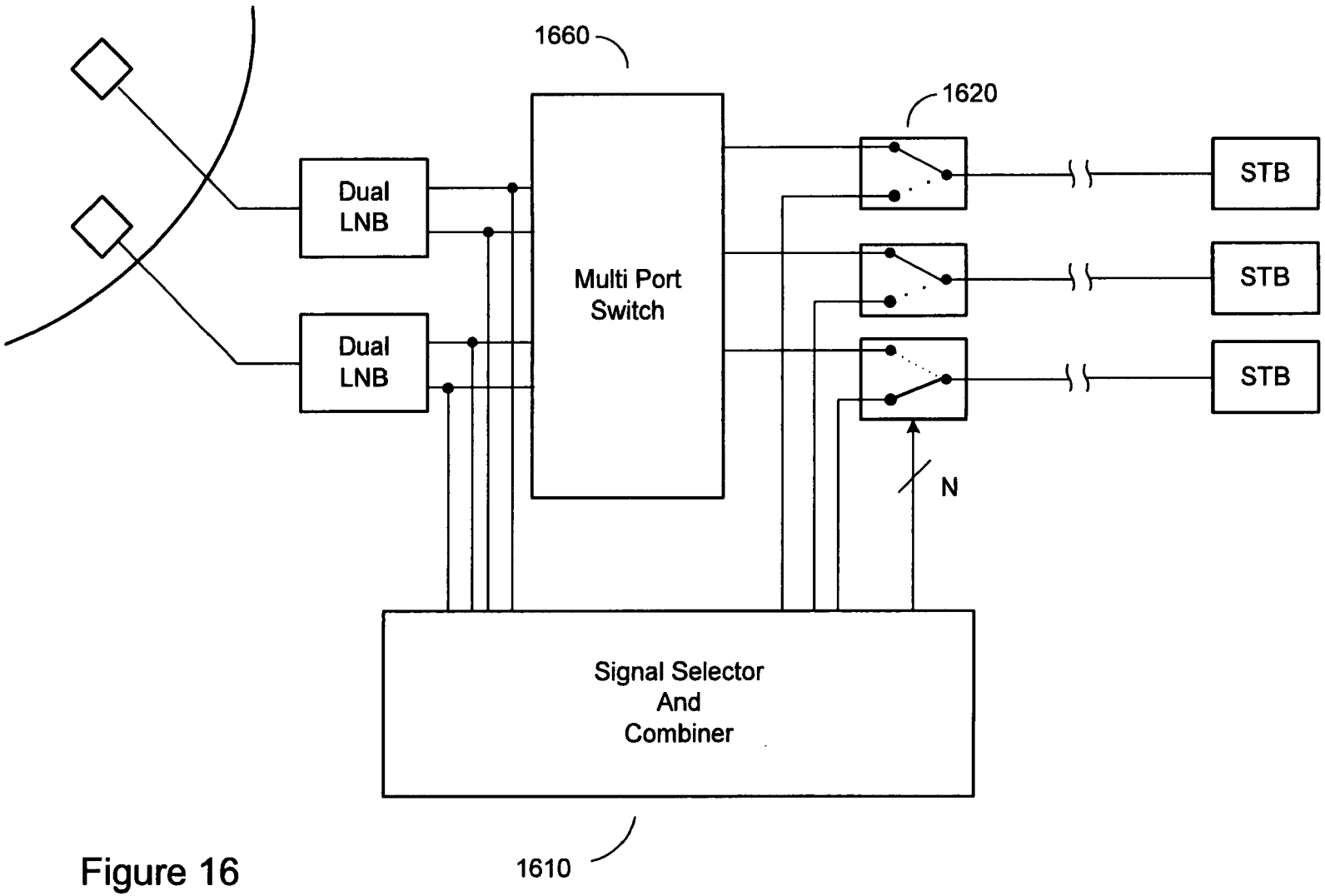
FIG. 16 is a block diagram illustrating details of an outdoor unit providing compatibility with new and existing STBs.

In FIG. 16, signal selector and combiner 1620 taps the signals output from each LNB to provide the transponder selection function. Switch 1620 is under control of the signal selector and combiner 1610. Switch 1620 will be actuated to supply either a conventional signal from multiport switch 1660 or the composite transponder signal from signal selector and combiner 1610. Switch 1620 can be a solid-state device or electro-mechanical relay.

Figure 17:
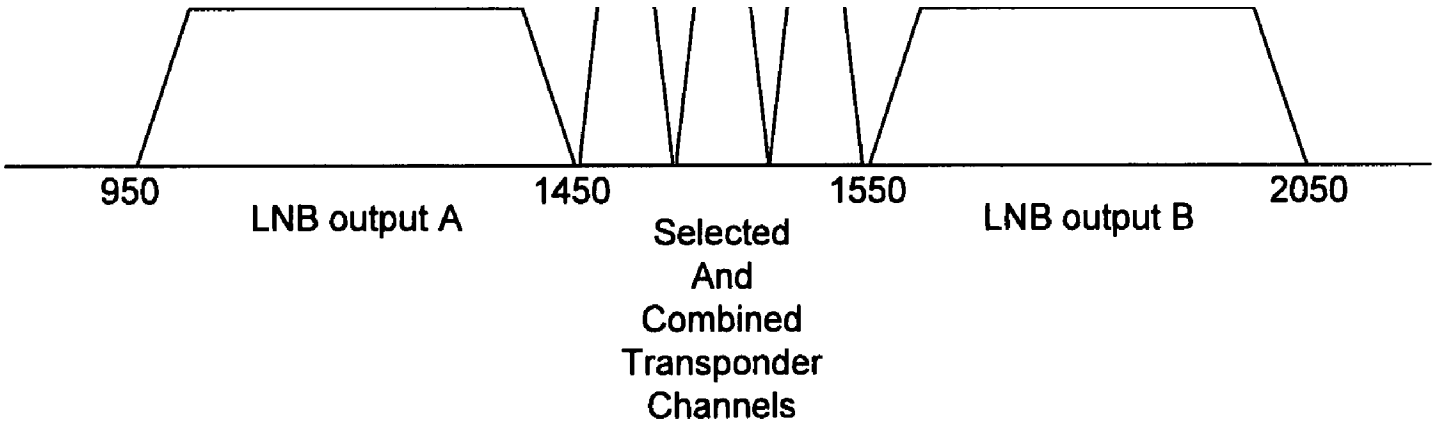
FIG. 17 is a signal diagram illustrating the frequency spectrum of conventional LNB signals combined with selected transponder channels.

FIG. 17 illustrates another application is to provide selected transponder signals along with other services transmitted on the same cable wiring. The selected transponder signals can be transmitted in unoccupied regions of the cable, such as above, below, or between broadband satellite signals. The number of transponder channels transmitted can be adapted to the available spectrum. In one example, 950 MHz to 1450 MHz is used by one conventional LNB output signal; 1550 MHz to 2050 MHz is used by another conventional LNB output, leaving 1450 MHz to 1550 MHz available. One or more selected transponder channels from any LNB can be inserted into this region. Suitable guard bands need to be provided to prevent interference, for example 3 transponder channels at 31.25 MHz spacing uses 93.75 MHz. Another example of this application is to combine a standard CATV signal occupying 50 to 750 MHz with selected satellite transponder channels that are combined and transmitted at frequencies above the CATV band.

Any number of transponder channels can be selected and combined. Conventional IRD tuners are designed to tune channels anywhere in a 500 MHz or 1000 MHz range, requiring a wide tuning range for the front-end filter and local oscillator. In an application where few channels are needed, the tuner range can be narrower, thus simplifying the design and lower cost. For example, a residential installation may typically have four television sets, some tuning only one channel at a time; others tune two channels in the case of picture in picture (PIP) or personal video recorder (PVR). This application would require 4 to 8 channels be distributed in the house simultaneously. A tuner would be required to tune over a 125 MHz to 250 MHz range.

Several variations in architecture are possible. At each stage in the signal path, alternatives are available for implementation. Specific functions can be implemented in the analog domain or digital domain. Dedicated resources can be provided for each possible connection, or a pool of resources can be used. Dedicated resources insure that the peak demand can be satisfied unconditionally, but leads to unused capacity. Pooling enables a trunking efficiency to be realized and exploits statistical properties of usage to address most requirements.

A pool of A/D converters that can accept a signal from any LNB output through an RF crossbar switch. The number of simultaneous LNB signals that can be processed is limited to the number of A/D converters provided. Alternatively, dedicated A/D converters, one connected to each LNB output allows all LNBs to be processed if needed.

A pool of filter/selectors connected to a common bus, the pool size dictating the number of simultaneous transponder channels that can be selected. Alternatively, a predetermined number of filters can be attached to each A/D converter.

The filters/selectors can be grouped with each LNB or can be a common resource available to process any signal from any LNB. This choice trades off circuit complexity of implementing more filters with circuit complexity of routing LNB outputs through a crossbar switch.

Each of the operations of mixing, filtering, and combining can be done as an analog operation or digital operation. Partitioning of functions can take a number of forms. The circuitry can be implemented in a monolithic integrated circuit (IC), a hybrid, discrete components, or a combination of technologies.

Another application is to simplify upgrades to an existing system. A dual tuner STB that enables viewing and recording of two different channels requires two input cables to allow any combination of LNB signals to be received. A single cable input would be limited to viewing and recording two channels from the same LNB output. When the upgrade is performed, the installation of an additional cable is difficult. By selecting and combining the desired channels at the ODU a single cable can be used to transmit all channels. A re-map of channel locations occurs. A conventional dual tuner STB can be used with this approach by providing a splitter at the input to the STB that supplies the composite signal to both cable inputs. A software upgrade to the STB may be needed to support the channel re-mapping.

Other implementations for signal processing include: No cross point switch, digitize, digital filter select, frequency translate, RF combine; cross point switch, analog tuner select, frequency translate, RF combine; digitize, digital filter select, digital network combine; digitize, digital filter select, decode, MPEG stream over a network; digitize, digital filter select, decode, MPEG to analog, restack channels, RF combine. One skilled in the art will recognize that many variations are possible to implement the selection of signals and combination of signals onto a signal cable.

The process of digitizing, selecting, and combining is modulation independent. Either a digital or analog selecting and combining approach can be designed to process any form of phase/amplitude modulation. Although the dominant modulation type in direct broadcast satellite systems is QPSK, alternatively BPSK, 8-PSK or multi-level QAM and PSK signals can be distributed in the same way.

Figure 18:
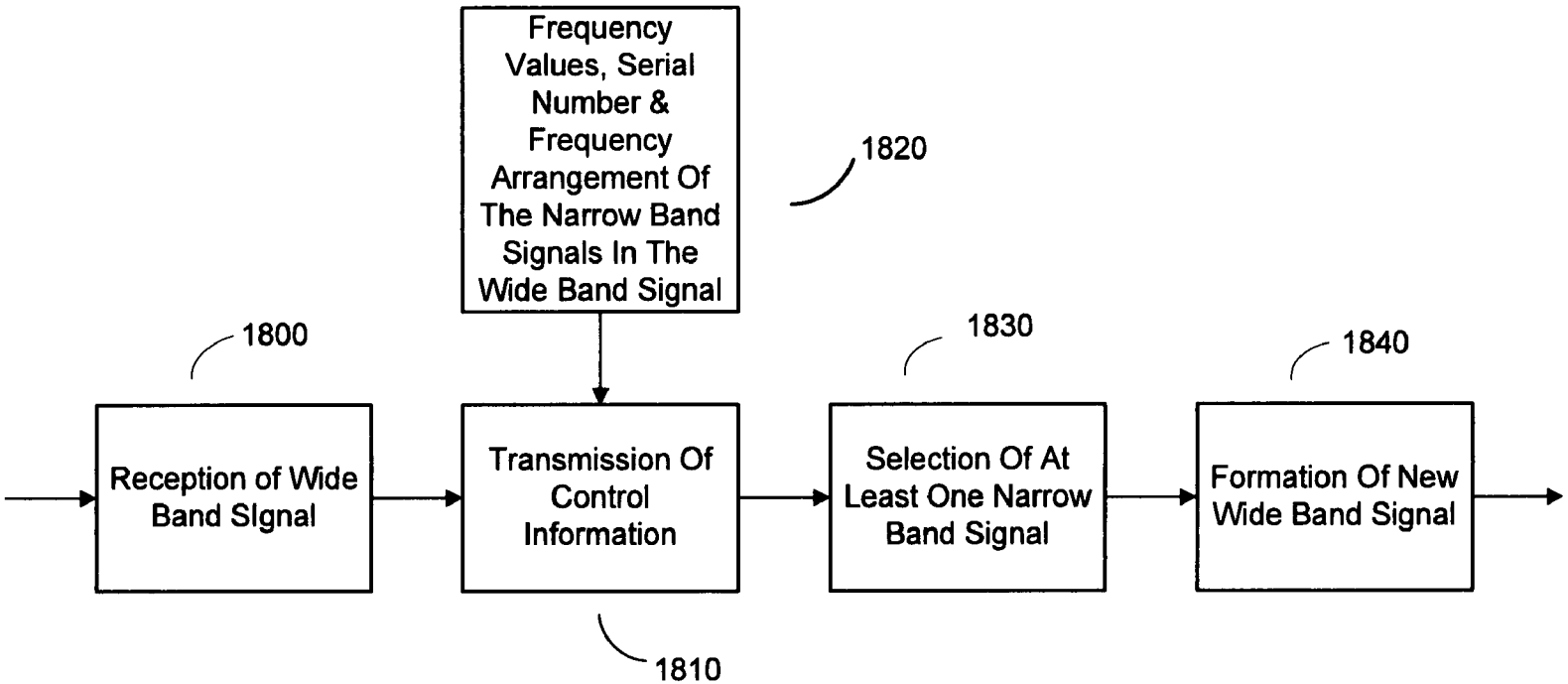
FIG. 18 is a block flow diagram illustrating a flow chart of the methodology of the signal processing conducted by the signal distribution system.

FIG. 18 illustrates a flow chart of the signal distribution system. A wide band signal is received by a LNB 1800 by a signal selector system that may comprise a signal receptor system, a frequency selector system and a frequency translation system. The wide band signal may comprise at least one satellite signal, a satellite polarization or a portion of a satellite polarization. Connected to the signal selector system is a communication system capable of transmitting control information 1810 from a user. This control information 1820 may include frequency values for the narrow band signals selected from the wide band signal. The control information may also include order arrangement values of the narrow band signals, serial number arrangement of where the serial numbers are assigned to the narrow band signals, and etc. The signal selector system 1800 is capable of selecting 1830 at least one of the narrow band signals for further processing as described above. After processing of the narrow band signal described above the narrow band signals are arranged to form a new wide band signal for output from the system.

While various embodiments of the invention have been described, it will be apparent to those of ordinary skill in the art that other embodiments and implementations are possible that are within the scope of this invention. Accordingly, the invention is not restricted except in light of the attached claims and their equivalents.

We claim:

1. A signal distribution system, comprising:

a signal selector system further comprising:

a signal receptor system capable of receiving at least one wideband signal that comprises a plurality of narrow band signals;

a frequency selector system that is capable of selecting at least one narrowband signal from the at least one wideband signal;

a frequency translation system that is capable of forming a new wideband signal from the selected at least one narrowband signal; and a communicator system enabling a connected device to communicate to the signal selector system.

2. The signal distribution system according to claim 1, where the at least one wideband signal includes at least one satellite signal.

3. The signal distribution system according to claim 2, where the at least one narrowband signal comprises at least one satellite carrier signals.

4. The signal distribution system according to claim 2, where the at least one wideband signal comprises at least a portion of a single satellite polarization.

5. The signal distribution system according to claim 4, where the at least a portion of the single satellite polarization is at an L-band frequency.

6. The signal distribution system according to claim 2, where the at least one wideband signal comprises at least one single satellite polarization.

7. The signal distribution system according to claim 6, where the at least one single satellite polarization is at an L-band frequency.

8. The signal distribution system according to claim 2, where the at least one wideband signal comprises a portion of a satellite polarization at L-band frequencies and the at least one narrowband signal comprises at least one single carrier signal per transponder.

9. The signal distribution system according to claim 2, where the at least one wideband signal comprises a satellite polarization at L-band frequencies and the at least one narrowband signal comprises at least one single carrier signal per transponder.

10. The signal distribution system according to claim 2, where the at least one wideband signal comprises a satellite polarization at L-band frequencies and the new wideband signal is at L-band frequencies.

11. The signal distribution system according to claim 2, where the satellite signal comprises at least one satellite carrier signal.

12. The signal distribution system according to claim 11, where the satellite carrier signal further comprises a single channel per the single carrier signal.

13. The signal distribution system according to claim 1, where the communicator system transmits user selected narrowband signal selection information.

14. The signal distribution system according to claim 13, where the narrowband signal selection information comprises frequency values.

15. The signal distribution system according to claim 13, where the narrowband signal selection information comprises order of arrangement of narrowband signals.

16. The signal distribution system according to claim 13, where the selected location comprises frequency values.

17. The signal distribution system according to claim 13, where the selected location comprises order of arrangement of narrowband signals.

18. The signal distribution system according to claim 13, where the new wideband signal is formed in less than 3 seconds after the transmission of the user selected narrowband signal frequencies selection information.

19. The signal distribution system according to claim 1, where the communicator system transmits user selected location for the at least one narrowband signal in the new wideband signal.

20. The signal distribution system according to claim 1, where the new wideband signal is formed in less than 3 seconds.

21. The signal distribution system according to claim 1, where communicator system interfaces with the signal selector system via a wired link.

22. The signal distribution system according to claim 1, where communicator system interfaces with the signal selector system via an optical link.

23. The signal distribution system according to claim 1, where communicator system interfaces with the signal selector system via a wireless link.

24. The signal distribution system according to claim 1, where the signal selector system is connected to at least one indoor device by a signal distribution sub-system.

25. The signal distribution system according to claim 1, where the selection of the at least one narrowband signal can be communicated to the signal selector system by at least one devices connected by a signal distribution sub-system.

26. The signal distribution system according to claim 1, where the selection of the at least one narrowband signal is transmitted from the communicator system on a single communications channel frequency.

27. The signal distribution system according to claim 1, where the selection of the at least one narrowband signal is transmitted by the communicator system by using a packet based communication network.

28. The signal distribution system according to claim 1 where the selection of the at least one narrowband signal is transmitted by the communicator system by using time division multiplexing.

29. The signal distribution system according to claim 1, where the selection of the at least one narrowband signal is transmitted by the communicator system by using frequency division multiplexing.

30. The signal distribution system according to claim 1, where the selection of the at least one narrowband signal is transmitted by the communicator system by using code division multiplexing.

31. The signal distribution system according to claim 1, where the selection of the at least one narrowband signal is transmitted by the communicator system by using orthogonal frequency division multiplexing.

32. The signal distribution system according to claim 1, where the signal selector system further comprises a controller that receives the narrowband channel selection information from the communicator system and generates control signals for the frequency selector to select the at least one narrow band signal.

33. The signal distribution system according to claim 32, where the narrowband channel selection information comprises frequency values.

34. The signal distribution system according to claim 32, where the narrowband channel selection information comprises channel number values.

35. The signal distribution system according to claim 32, where the narrowband channel selection information comprises channel sequence values.

36. The signal distribution system according to claim 32, where the narrowband channel selection information comprises selection of the narrowband signals based on the allocation of a serial number for each of the narrowband signals.

37. The signal distribution system according to claim 32, were the controller comprises a microprocessor.

38. The signal distribution system according to claim 1, where the signal selector system further comprises a controller that generates control signals for the frequency selector system to use in formulating the new wideband signal.

39. The signal distribution system according to claim 1, where the signal selector system functionality is embedded in an LNB.

40. A signal distribution system, comprising:

a signal selector system, comprising:

a first and a second signal receptor system capable of receiving at least one wideband signal that comprises a plurality of narrow band signals;

a first and a second frequency selector system that is capable of selecting at least one narrowband signal from the multiple wideband signal;

a first and a second frequency translation system that is capable of forming a new wideband signal from the selected at least one narrowband signal; and a communicator system enabling a connected device to communicate to the signal selector system allowing the selection of the narrow band signals by the first and second frequency selector systems.

41. The signal distribution system according to claim 40, where the at least one wideband signal includes at least one satellite signal.

42. The signal distribution system according to claim 41, where the satellite signal comprises at least one satellite carrier signal.

43. The signal distribution system according to claim 42, where the satellite carrier signal further comprises a single channel per the single carrier signal.

44. The signal distribution system according to claim 41, where the at least one wideband signal comprises a portion of a satellite polarization at L-band frequencies and the at least one narrowband signal comprises at least one single carrier signal per transponder.

45. The signal distribution system according to claim 41, where the at least one wideband signal comprises a satellite polarization at L-band frequencies and the at least one narrowband signal comprises at least one single carrier signal per transponder.

46. The signal distribution system according to claim 41, where the at least one wideband signal comprises a satellite polarization at L-band frequencies and the new wideband signal is at L-band frequencies.

47. The signal distribution system according to claim 41, where the at least one narrowband signal comprises at least one satellite carrier signals.

48. The signal distribution system according to claim 41, where the at least one wideband signal comprises at least a portion of a single satellite polarization.

49. The signal distribution system according to claim 48, where the at least a portion of the single satellite polarization is at an L-band frequency.

50. The signal distribution system according to claim 41, where the at least one wideband signal comprises at least one single satellite polarization.

51. The signal distribution system according to claim 50, where the at least one single satellite polarization is at an L-band frequency.

52. The signal distribution system according to claim 40, where the communicator system transmits user selected narrowband signal selection information.

53. The signal distribution system according to claim 52, where the narrowband signal selection information comprises frequency values.

54. The signal distribution system according to claim 52, where the narrowband signal selection information comprises order of arrangement of narrowband signals.

55. The signal distribution system according to claim 52, where the selected location comprises frequency values.

56. The signal distribution system according to claim 52, where the selected location comprises order of arrangement of narrowband signals.

57. The signal distribution system according to claim 52, where the new wideband signal is formed in less than 3 seconds after the transmission of the user selected narrowband signal frequencies selection information.

58. The signal distribution system according to claim 40, where the communicator system transmits user selected location for the at least one narrowband signal in the new wideband signal.

59. The signal distribution system according to claim 40, where the new wideband signal is formed in less than 3 seconds.

60. A method for a signal distribution system, comprising:

receiving at least one wideband signal by a signal selector system comprising a signal receptor system, a frequency selector system and a frequency translation system;

transmitting control information by a communicator system to the signal selector system;

selecting at least one narrowband signal from the at least one wideband signal by the frequency selector system based on the control information; and forming a new wideband signal from the selected at least one narrowband signal by the frequency translation system based on the control information.

61. The method for a signal distribution system according to claim 60, where the receiving at least one wideband signal comprises at least one satellite signal.

62. The method for a signal distribution system according to claim 60, where the receiving at least one wideband signal comprises at least a portion of a satellite polarization.

63. The method for a signal distribution system according to claim 60, where the receiving at least one wideband signal comprises at least one single satellite polarization.

64. The method for a signal distribution system according to claim 60, where the control information further comprises frequency values for the frequency selector system to select appropriate the narrowband signals from the wideband signal.

65. The method for a signal distribution system according to claim 60, where the control information further comprises order arrangement values for the frequency selector system to select the narrowband signals from the wideband signal.

66. The method for a signal distribution system according to claim 60, where the control information further comprises order arrangement values for the frequency selector system to select the narrowband signals from the wideband signal.

67. The method for a signal distribution system according to claim 60, where the control information further comprises serial number arrangement values for the frequency selector system to select the narrowband signals from the wideband signal.

68. The method for a signal distribution system according to claim 60, where the control information further comprises frequency values for the frequency translator system to form the new wideband signal from the narrowband signals.

69. The method for a signal distribution system according to claim 60, where the control information further comprises order arrangement values for the frequency translator system to form the new wideband signal from the narrowband signals.

70. The method for a signal distribution system according to claim 60, where the control information further comprises serial number arrangement values for the frequency translator system to form the new wideband signal from the narrowband signals.

71. The method for a signal distribution system according to claim 60, where the new wideband signal is formed in less than 3 seconds after transmission of control information.

72. The method for a signal distribution system according to claim 60, where the transmitting of control information from the communicator system to the signal selector system is accomplished on a wired pathway.

73. The method for a signal distribution system according to claim 60, where the transmitting of control information from the communicator system to the signal selector system is accomplished on a wireless pathway.

74. The method for a signal distribution system according to claim 60, where the transmitting of control information from the communicator system to the signal selector system is accomplished on an optical pathway.

* * * * *